United States Patent [19]

Erickson

[11] Patent Number: 4,909,156

[45] Date of Patent: Mar. 20, 1990

[54] BLADDER-TARP

[76] Inventor: Stewart E. Erickson, P.O. Box 4511, Ketchum, Id. 83340

[21] Appl. No.: 256,035

[22] Filed: Oct. 11, 1988

[51] Int. Cl.[4] ..... B61D 5/00; B65D 88/00

[52] U.S. Cl. ..... 105/359; 105/423; 220/1.5; 383/902

[58] Field of Search ..... 105/359, 377, 423, 360; 296/98, 100, 39.2; 220/1.5, 85 B, DIG. 24; 383/4, 902

[56] References Cited

U.S. PATENT DOCUMENTS

| | | | |
|---|---|---|---|
| 2,712,797 | 7/1955 | Woehrle et al. | 105/423 X |
| 3,806,185 | 4/1974 | Brandjord | 296/98 |
| 4,013,018 | 3/1977 | Hansen et al. | 296/100 X |
| 4,557,400 | 12/1985 | Clarke | 220/1.5 X |
| 4,613,053 | 9/1986 | Kimura et al. | 105/359 X |

*Primary Examiner*—Robert J. Oberleitner

*Attorney, Agent, or Firm*—Gregory P. Kaihoi; James R. Haller; Mary P. Bauman

[57] ABSTRACT

A liquid-retaining railroad car liner for lining the interiors of railroad cars enabling the cars to transport liquids. The liner serves as a bladder which may be carried by an open-topped railroad car enabling the car to be filled with liquid. The bladder, when empty, can be flattened and used as a waterproof tarpaulin to cover cargo carried by a railroad car thus protecting the cargo from the elements and helping to prevent spillage on railways.

10 Claims, 1 Drawing Sheet

BLADDER-TARP

FIELD OF THE INVENTION

The invention relates to railroad car liners, and more particularly to a liquid retaining railroad car liner that is adaptable to be used as a tarp to cover cargo carried by railroad cars.

BACKGROUND OF THE INVENTION

Several types of railroad cars are used to haul bulk shipments of materials. Fluids such as fossil fuels and various liquid chemicals are typically carried in entirely enclosed liquid tanker cars. Tanker cars are generally filled pumping the liquid into the top of the tanker through one or more closable openings. The openings are capped to protect the contents of the tanker from the elements and to prevent foreign substances from entering the tanker. Such tanker cars are generally unloaded through several valves carried by the lower portion of the tanker. The force of gravity acting on the liquid forces the liquid out of the tanker and into a receptacle.

Particulate or granular commodities such as coal and grain are generally transported by rail in open-topped hopper cars. Such hopper cars generally have a number of vertical walls extending upwardly from a floor comprised of a plurality of conical or "V" shaped depressions that converge downwardly into a flow control valve system carried by the lower portion of the car. The hopper cars are loaded through the upper open top and are unloaded through the valve controlled openings carried by the lower portion of the car.

By their very construction tanker cars are unsuitable for hauling anything but fluids. Similarly hopper cars are unsuitable for hauling anything but granular commodities. A result of this dedicated use construction is that such cars frequently carry loads only in one direction, returning empty. For example, coal cars carry coal from mines to market, and return empty, reslting in high operating expenses for the railroad (including fuel for transporting empty cars) and high capital costs (for single purpose cars which ride the rails empty half the time.)

SUMMARY OF THE INVENTION

The invention relates to a waterproof bladder for lining the interior of a railroad hopper car to transport liquids, the liner comprising a liquid-tight bladder having a closable filling means, a closable emptying means, and means for removably attaching the liner to a railroad car. When the bladder of the invention is empty, it is adaptable to be flattened out and used as a tarpaulin to cover cargo carried by a railroad car.

DETAILED DESCRIPTION OF THE PREFERRED EMBODIMENT

Figure 1:
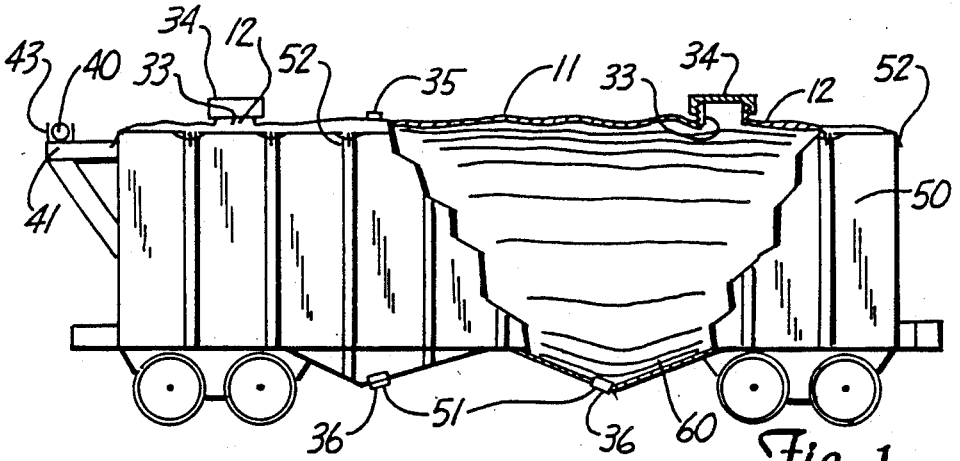
FIG. 1 is an elevation view of a railroad car within which is carried the liner of the invention.

The railroad car liner of the invention comprises a three dimensional generally rectangular flexible bladder (11), as shown in FIG. 1, which is placed in the interior of a railroad car (50) enabling the railroad car (50) to transport liquids (60). Preferably the bladder (11) is formed out of a strong durable rubber material with adequate flexibility to allow it to conform to the interior of a railroad car (50). The bladder (11) is structurally supported by the railroad car (50) and preferably comprises a fully enclosed, substantially leak-proof bag suitable for transporting liquid substances. The material comprising the bladder (11) preferably possesses good chemical resistance properties so that its performance is not substantially affected by the chemicals contained within it or exposed to its exterior. The bladder (11) must also resist the sun's radiation and be able to withstand extremes of heat and cold to which it may be exposed.

Carried by the upper portion of the bladder (11) are one or more closable filling ports (12) through which liquid may be introduced to the bladder (11). Any suitable nozzle mechanism will suffice. Preferably the filling ports (12) comprise rigid threaded hose fittings (33) which are permanently attached to the upper portion of the bladder (11) and contain a central opening through which a liquid may be added to the bladder (11). A threaded cap (34) may be screwed onto the hose fitting (33), providing a leak-proof seal to keep the liquid in the bladder (11). A locking device may be included on the filling ports (12) to prevent unauthorized persons from gaining access to the inside of the bladder (11). A gas release valve (35) may be included to allow gases to escape when the bladder (11) is being filled, thus controlling the pressure in the bladder (11). The gas release valve (35) may employ automatic pressure relief means for releasing accumulated gas from the bag as required (e.g., gas pressure accumulated under elevated temperature conditions).

Carried by the lower portion of the bladder (11) are a plurality of emptying ports through which the contents of the bladder (11) may be emptied. The emptying ports are preferably comprised of a plurality of closable discharge valves (36) which may be adjustable so that the flow rate of the liquid exiting the bladder (11) may be controlled. The discharge valves (36) desirably protrude into the proximity of the hopper doors (51) carried by the bottom of the hopper car (50) so that the valves can be easily opened when the hopper doors (51) are opened. The discharge flow is induced by gravity and may be facilitated by pressurization. The discharge valves (36) may be of an obstruction screw type which would allow the valves to be adjusted to a desired flow rate. The discharge valves (36) carried by the bladder (11) may include a suspension rope so that they may be removed from the hopper doors (51) from a remote position. A locking mechanism may be employed on the discharge valves (36) or hopper doors (51) to prevent them from accidentally opening and to prevent unauthorized persons from opening the valves.

Figure 3:
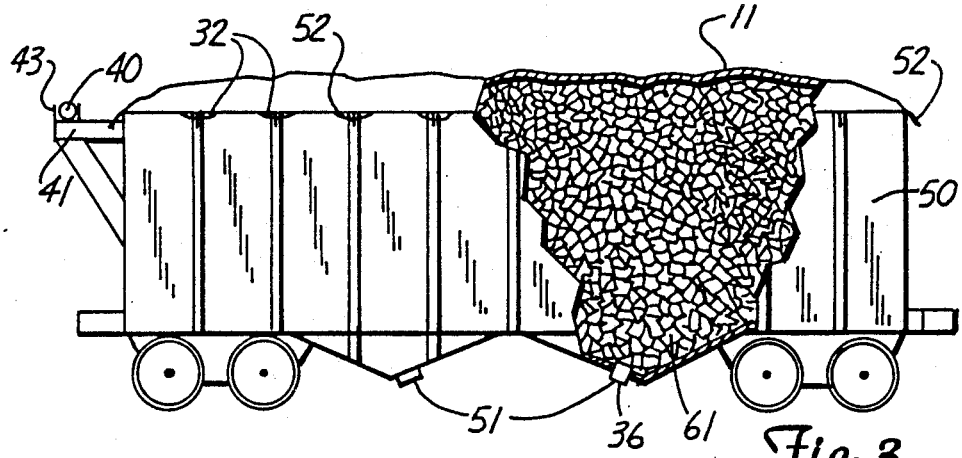
FIG. 3 is an elevation view of a railroad car showing the liner of the invention deployed as a tarpaulin to cover cargo carried by the railroad car.

When the bladders (11) are not being used to transport liquid, they may be collapsed into a generally flat shape, as shown in FIG. 3, for use as a tarpaulin to cover cargo (61) carried by the railroad car (50). The tarpaulin provides a waterproof cover to protect the cargo (61) from the elements and to prevent the cargo from spilling or blowing out of the car (e.g. coal dust).

In one embodiment a plurality of heavy duty grommets or other suitable attachment means are carried by the bladder (11) through which an anchoring line (32)

may be passed for removable attachment to the railroad car (50). The anchoring line (32) is preferably secured to the railroad car (50) by eyelets, cleats, or other anchoring means (52) carried by the railroad car (50). The sides of the tarpaulin are secured to the railroad car (50) by threading the anchoring line (32) alternately through the attachment means carried by the tarpaulin and the attachment means (52) carried by the railroad car (50). A pair of end lashing ropes may be used to secure the ends of the tarpaulin to the respective ends of the railroad car (50) and to stretch the tarpaulin across the cargo (61) carried by the railroad car (50).

Desirably means is employed for removing the bladders (11) from the railroad cars (50) and rolling them for storage. A preferred means comprises a movable rolling bar (40), retaining means (41) for the rolling bar, and a number of attachment devices. An empty bladder (11) is removed from a railroad car (50) by attaching one end of the bladder (11) to the rolling bar (40) and rolling the rolling bar (40) closely along the top surface of the bladder (11), accumulating the bladder (11) thereupon in a spiral roll configuration as exemplified in FIG. 2. The bladder roll is then placed on the rolling bar retaining means (41) which is carried adjacent an end of the railroad car (50). The rolling bar retaining means (41) preferably comprises a pair of "U" shaped brackets (43) attached to an end of the railroad car (50) to receive opposite ends of the rolling bar (40) and retain them securely thereupon.

In order to utilize the bladder (11) of the invention, the bladder (11) is placed inside of an open-top hopper railroad car (50), with its discharge valves (36) closed. The valves are placed adjacent the closed hopper doors (51) of the railroad car (50), either manually or by utilizing suspension ropes carried by the discharge valves (36). Once the discharge valves (36) are in place, the bladder (11) may be lowered into the car (50) and positioned so that it generally evenly covers the floor of the car throughout its length. The bladder (11) is then ready to be filled.

To fill the bladder (11), the caps carried by the filling ports (12) are opened and a filling hose is applied to the filling port (12). Liquid is then pumped into the bladder (11) while it is visually monitored to determine if it is properly and evenly seated in the car. If it is not properly seated, it can be adjusted easily at this time before the bladder (11) is too heavy to adjust. As the bladder (11) is filled with liquid, it conforms to the shape of the interior of the hopper car (50), closely contacting the crossridge braces and longitudinal hood of the car. The gas release valve (35) may be used to release air and gases from the bladder (11). When the bladder (11) is filled to a predetermined height, preferably below the top rim of the car, the flow of liquid is stopped, the filling hose is removed, and the filler caps (34) are replaced and locked. The attachment lines and the rolling bar are secured in place on the railroad car readying the car for transport.

When the full car reaches its destination, the hopper doors (51) are positioned over the discharge point and then opened to expose the bladder's discharge valves (36). The discharge valves (36) are then opened to a position at which a desired flow rate is obtained. When the bladder (11) is empty, the discharge valves (36) are closed and the bladder (11) is readied to be removed and stored. In the case of a bladder (11) in a rotary-dump rail car, the car may be rotated and the bladder (11) drained through the fill port (12); this would require securing the bladder to prevent it from falling out, and therefore a preferred method is to either siphon the bladder contents out through the fill port, or to pressurize the bladder at one port to expel the contents at another port.

The bladders (11) may be rolled and stored either manually or through the use of a rolling machine. The bladder rolling process is started by first untying the bladder (11) from the end of the car opposite the rolling bar retaining means (41). The rolling bar (40) is then extended transversely across the same end of the bladder and secured to the bladder (11) using the end lashing ropes. The rolling bar (40) preferably includes a plurality of cleats and hooks comprising the attachment means for attaching the bladder (11). The anchoring ropes holding the longitudinal sides of the bladder (11) to the car (50) are now removed. With the ends of the rolling bar (40) preferably supported by the longitudinal side rim of the railroad car (50), the bladder (11) is rolled tightly in a spiral configuration onto the bar (40). When the roll on the bar (40) encounters a discharge valve (36), the valve is hoisted to closely contact the roll and is consumed in the roll.

Figure 2:
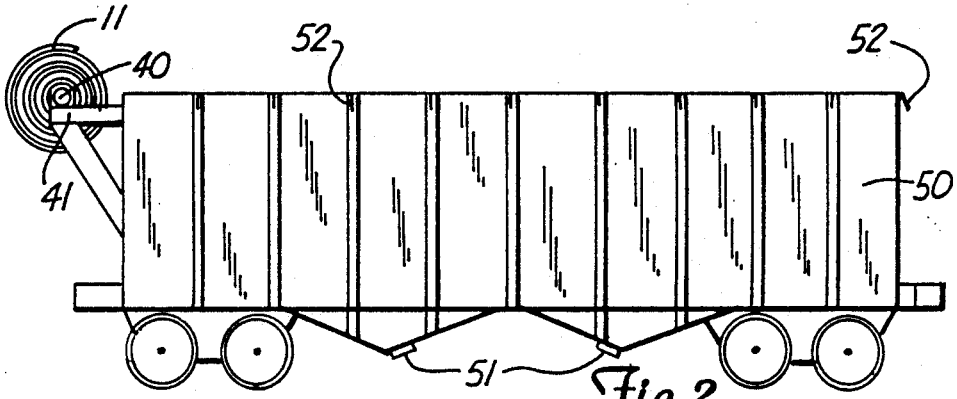
FIG. 2 is an elevation view of a railroad car showing the liner stored in a rolled position.

When the roll reaches the opposite end of the car (50), it is rolled over the edge of the car (50) and into the rolling bar retaining means (41) which suspends and retains the roll adjacent the outside end of the car (50) as shown in FIG. 2. The rolling bar retaining means (41) preferably includes a "U" shaped bracket (43) for retaining the rolling bar (40). The end anchoring rope may remain attached to the end of the car (50) and the end of the bladder (11). The roll is then secured to the car (50) to prevent it from unrolling and from falling off the car (50). This procedure allows the railroad car (50) to be filled with cargo (61) without the bladder (11) obstructing the loading process.

When the hopper car (50) is filled with cargo (61), the bladder (11) may be deployed as a tarpaulin to protect the cargo (61) from the elements as shown in FIG. 3. In order to deploy the bladder (11) as a tarpaulin, the bladder (11) is loosened from its lashed attachment to the car (50), removed from the brackets (43), and rolled over the upper surface of the cargo (61) towards the opposite end of the car (50). The bladder (11) is then stretched over the cargo (61) and lashed tightly to both ends of the car (50). The sides of the bladder (11) are lashed to the sides of the car (50) and the suspension ropes are secured to the car (50). The tarpaulin [bladder (11)] will not only protect the contents of the car from the elements but will also help prevent them from spilling or blowing onto the railway.

When the car (50) reaches its destination, the cargo may be removed by one of several methods depending on the type of cargo carried and the configuration of the car. In some instances, the tarpaulin may be removed from the car (50) to facilitate unloading. This is necessary when the nature of the cargo is such that the tarpaulin will not easily descend into the car as the cargo is removed. Also, the tarpaulin is removed from the car when the car is unloaded by rotary-dumping of the cargo out through the top of the car. The tarpaulin is removed by first unlashing it from the ends of the car (50). The rolling bar (40) is then positioned adjacent and parallel to the end of the tarpaulin opposite the rolling bar retaining means, and the end ropes of the tarp are securely attached to the bar (40). The side ropes are then removed from their engagement with the tarp and the car (50), enabling the tarp to be rolled onto the bar (40). When the tarp is completely rolled up, it is hoisted over the end of the car into the retaining bracket (43) and lashed to the car (50) for transport. The cargo (61) is then emptied and the process is repeated.

Another method of removing cargo enables the tarpaulin to be kept in place atop the cargo while the cargo is removed. The tarpaulin is secured over the cargo in such a manner as to allow the cargo to be removed from the hopper doors without removing the tarpaulin. As exits from the hopper doors, the level of the cargo within the car steadily lowers allowing the lower portion of the tarpaulin to sink into and conform to the inside walls of the car. When the car is empty of cargo, the discharge nozzles of the bladder may be positioned adjacent the hopper doors readying the bladder for filling.

While a preferred embodiment of the present invention has been described, it should be understood that various changes, adaptations and modifications may be made therein without departing from the spirit of the invention and the scope of the appended claims.

What is claimed is:

1. A liner for the interior of an open top railroad car enabling the car to transport liquids, comprising a collapsible, liquid-tight bladder, filling port means for introducing liquid into the bladders, emptying port means for removing liquid from the bladder, and attachment means for removably attaching the liner to the railroad car, the liner being configured to line substantially the entire interior of the car and being collapsible into a generally flat shape usable as a tarpaulin to cover cargo carried in the railroad car.

2. The railroad car liner of claim 1 wherein said liner is made of a flexible material and is sized to closely conform to the shape of the interior of the railroad car, being supported by the car's walls.

3. The railroad car liner of claim 1 wherein the filling port means comprises at least one hose fitting carried by an upper portion of the bladder and including capping means for preventing the liquid from exiting the bladder.

4. The railroad car liner of claim 1 wherein the emptying port means comprises at least one discharge valve carried by a lower portion of the bladder through which liquid may be drained from the bladder.

5. The railroad car liner of claim 1 wherein the attachment means comprises a plurality of attachment devices carried by the bladder and receivable on complimentary portions of the railroad car.

6. The railroad car liner of claim 1 including a gas release valve whereby accumulated gas may abe released from the bladder.

7. The railroad car liner of claim 1 including a removal means enabling the bladder to be removed from the car and stored allowing the car to be unobstructably loaded with cargo.

8. The railroad car liner of claim 7 wherein the removal means comprises a rolling bar upon which the liner can be spirally rolled and stored.

9. The railroad car liner of claim 8 wherein the removal means includes a retaining bracket carried by the railroad car to receive and retain the rolling bar.

10. A liner for the interior of a railroad car enabling the car to transport liquids comprising a collapsible, liquid-tight bladder made of flexible material and sized to closely conform to and be supported by the interior walls of the railroad car, the bladder including at least one hose fitting carried by an upper portion of the bladder for permitting liquid to be introduced into the bladder and including removable cap means for preventing the liquid from exiting the hose fittings, emptying port means for removing liquid from the bladder comprising at least one discharge valve carried by a lower portion of the bladder, attachment means for removably attaching the bladder to the railroad car, gas release valve means for releasing accumulated gas from the bladder, and removal means enabling the bladder to be removed from the car, the removal means comprising a rolling bar upon which the bladder may be rolled and a retaining bracket to receive and retain the rolling bar; the bladder being collapsible into a generally flat shape for use as a tarpaulin to cover cargo carried in the railroad car.

* * * * *

UNITED STATES PATENT AND TRADEMARK OFFICE

CERTIFICATE OF CORRECTION

PATENT NO. : 4,909,156

DATED : March 20, 1990

INVENTOR(S) : STEWART E. ERICKSON

It is certified that error appears in the above—identified patent and that said Letters Patent is hereby corrected as shown below:

Column 1, line 15, after "filled" insert --by-- .

Column 6, line 10, replace "abe" with --be-- .

Signed and Sealed this

Nineteenth Day of March, 1991

*Attest:*

HARRY F. MANBECK, JR.

*Attesting Officer*

*Commissioner of Patents and Trademarks*